United States Patent [19]

Boege et al.

[11] Patent Number: 4,773,552

[45] Date of Patent: Sep. 27, 1988

[54] CLOSURE FOR SAMPLE BOTTLES

[75] Inventors: Dietrich H. Boege, Ofenkuche; Wolfgang Riegger, Obere Kapellacker, both of Fed. Rep. of Germany

[73] Assignee: Bodenseewerk Perkin-Elmer & Co., GmbH, Uberlingen, Fed. Rep. of Germany

[21] Appl. No.: 46,481

[22] Filed: May 4, 1987

[30] Foreign Application Priority Data

Nov. 3, 1986 [DE] Fed. Rep. of Germany ... 8629214[U]

[51] Int. Cl.[4] ..... B65D 41/20

[52] U.S. Cl. ..... 215/247; 53/421; 215/350; 215/347

[58] Field of Search ..... 215/247, 249, 349, 350; 53/410, 420, 421

[56] References Cited

U.S. PATENT DOCUMENTS

| | | | |
|---|---|---|---|
| 1,341,382 | 5/1920 | Quarrier | 215/349 |
| 2,620,939 | 12/1952 | Weisgerber | 215/347 |
| 2,646,183 | 7/1953 | Pellett | 215/347 |
| 2,891,689 | 6/1959 | Gould | 215/249 |
| 3,552,591 | 1/1971 | Wimmer | 215/247 |
| 3,912,102 | 10/1975 | Michel | 215/249 |
| 4,248,355 | 2/1981 | Kolb et al. | 215/274 |

FOREIGN PATENT DOCUMENTS

| | | | |
|---|---|---|---|
| 1255739 | 12/1971 | United Kingdom | 215/350 |

*Primary Examiner*—Donald F. Norton
*Attorney, Agent, or Firm*—Ronald G. Cummings; Francis L. Masselle; Edwin T. Grimes

[57] ABSTRACT

A closure and method of assembly for sample vials comprising a cap and a septum with the septum having a plurality of radially extending protrusions for retentive engagement with the cap to retain the septum and annular disk within the cap during positioning of the closure on the sample vial.

11 Claims, 1 Drawing Sheet

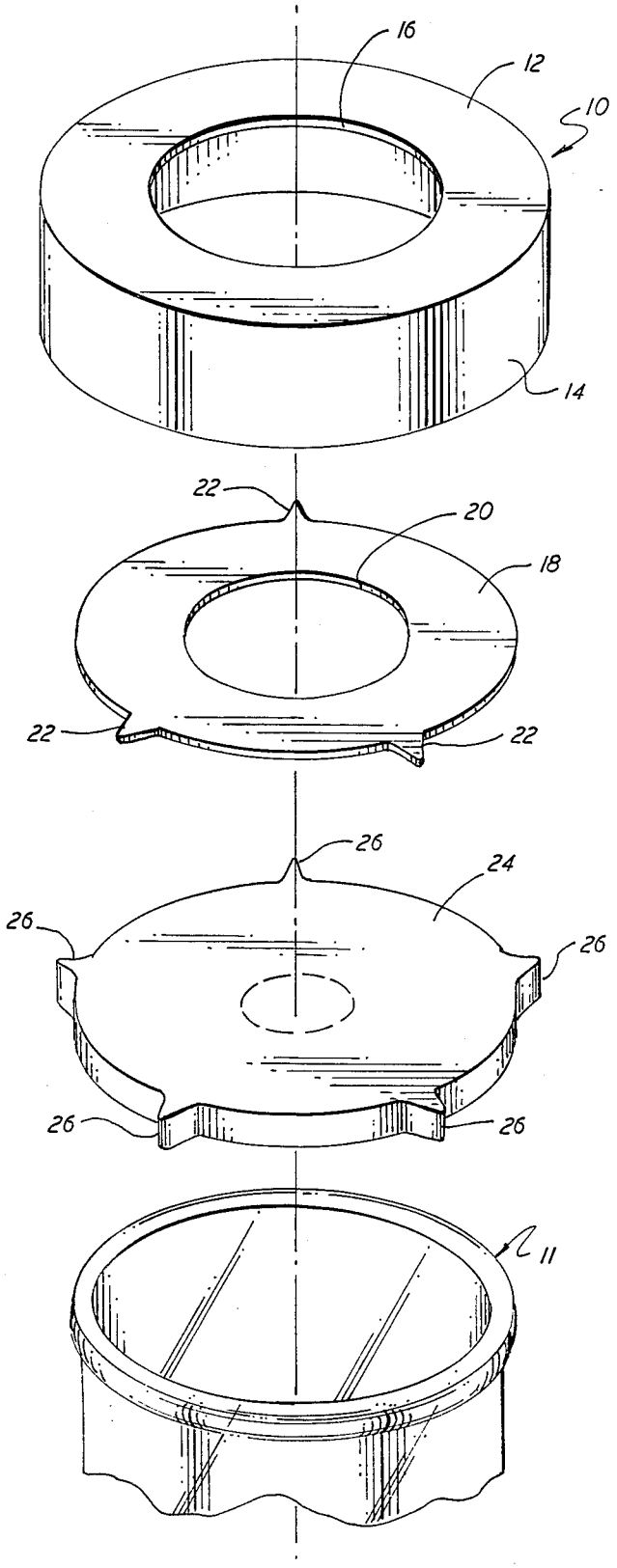
16
12
10
14
22
20
18
22
22
26
24
26
26
26
26
11

CLOSURE FOR SAMPLE BOTTLES

BACKGROUND AND SUMMARY OF THE INVENTION

This invention relates to sample vials and more particularly to a closure and method of assembly for a sample vial having particular utility in gas chromatography.

Closures for sample bottles such as those used for feeding samples in a gas chromatograph according to the head space method generally comprise a pot shaped metal cap with a central aperture and a septum. The septum is essentially in the form of a circular disc adapted to cover the opening of the sample bottle and is positioned within the cap. The septum is a disc of elastic material like rubber which can be pierced by a hollow needle and which reseals itself when the hollow needle is removed. Such a closure is shown in the commonly assigned Kolb et al., U.S. Pat. No. 4,248,355 issued Feb. 3, 1981 entitled "Closure for Sample Vials" which is incorporated in its entirely herein by reference.

In practice, there is a problem with such closures in that the circular septa easily falls out of the cap when the closure is turned to place it on the sample bottle. This is particularly true if a resiliently elastic annular disc having a central aperture is inserted between the metal cap and the rubber disc such as shown in U.S. Pat. No. 4,248,355.

It is also known from U.S. Pat. No. 4,248,355 that the annular disc has a smaller diameter than the metal cap and is centered therein by rounded radial projections. These projections have only the function of centering and are neither configured nor suited to hold the annular disc in the cap and secure it against falling out.

It is an object of the present invention to provide a new and improved closure for sample vials.

It is a further object of the invention to provide a closure and method of assembly which affords expeditious mounting to the sample vial.

A further object of the invention is to provide a closure for sample vials which prevents the septum from falling out of the cap during positioning of the closure on the sample vial.

Another object of the invention is to provide such a closure wherein the septum is frictionally mounted within the cap to also retain the annular disk within the cap during positioning of the closure on the sample vial.

Another object of the invention is to provide a closure for sample vials having particular utility for introducing samples into a gas chromatograph utilizing the vapor space (head space) method.

Other objects will be in part obvious and in part pointed out more in detail hereinafter.

Accordingly, it has been found that the foregoing and related objects may be attained in a closure comprising a pot shaped cap having a top wall with a central access aperture and a side wall forming a recess and a septum for covering the opening of the vial being of generally circular shape with a plurality of radially extending protrusions configured for retentive engagement with the cap side wall to retain the septum within the recess.

The method of assembling a closure on a sample vial comprises positioning the septum within the cap, securing the septum within the cap prior to mounting the cap on the sample vial and mounting the cap to the sample vial to seal the opening with the septum.

BRIEF DESCRIPTION OF THE DRAWING

FIG. 1 is an enlarged exploded perspective view of a closure for sample bottles according to the present invention.

DESCRIPTION OF THE PREFERRED EMBODIMENT

Although specific forms of the present invention have been selected for illustration in the drawings, and the following description is drawn in specific terms for the purpose of describing these forms of the invention, the description is not intended to limit the scope of the invention which is defined in the appended claims.

Referring to FIG. 1, the closure of the present invention for sample bottle 11 generally comprises a cap 10, a disk 18 and a septum 24. The cap 10 is a pot-shaped metal cap 10 with a top wall 12 and a cylindrical rim or side wall 14. The metal cap 10 has a central aperture 16 in the top wall 12.

The annular disc 18 is located in the metal cap 10 between the septum 24 and the top 12 and has a central aperture 20 which is slightly smaller than the aperture 16 of the metal cap 10. The annular disc 18 is smaller in diameter than the inner diameter of the metal cap and has three rounded radial projections 22 angularly spaced by 120° for centering the annular disc 18 in the recess of the metal cap 10.

The septum 24 is essentially in the form of a circular disc for covering the opening (not illustrated) of a sample bottle 11 and is located in the metal cap 10. The septum 24 is made of butyl rubber or silicone rubber which is laminated with PTFE or aluminum. The septum has a plurality of radial protrusions 26 at its circumference configured to resiliently and frictionally engage the inner wall of the metal cap 10 when the closure is assembled to retain the septum in the metal cap. In the illustrated embodiment, the protrusions 26 comprise five equi-spaced protrusions extending radially outwardly from the circumference of the generally circular septum 24. By the retentive engagement of the projections 26 with the inner wall of the rim 14, the septum 24 is held in the metal cap 10 when the metal cap 10 is turned as illustrated to place it on the bottle. The septum 24 also holds the annular disc 18 between the septum and the top wall 12 of the metal cap 10 while the closure is placed on the bottle and the main body of the septum 24 is practically not deformed or distorted thereby.

In assembling the closure on the sample vial, the septum is positioned within the cap thereby securing the septum within the cap by the frictional engagement of the septum protrusions with the cap prior to mounting the cap on the sample bottle. Where an annular disc is utilized, the annular disc is positioned in the cap prior to securing the septum within the cap so as to retain the annular disc within the cap during the pacement of the cap on the sample vial for mounting.

As can be seen, the closure of the present invention prevents the septum from falling out of the cap during placement on the sample vial and, moreover, the frictional mounting of the septum in the cap also retains the annular disc therebetween during placement to facilitate mounting of the closure on the sample vial.

As will be apparent to persons skilled in the art, various modifications and adaptations of the structure and method above described will become readily apparent without departure from the spirit and scope of the invention, the scope of which is defined in the appended claims.

What is claimed is:

1. A closure for a sample vial utilized for introducing a sample into a gas chromatograph in accordance with the head space method comprising a pot shaped cap having a top wall with a central aperture and a side wall forming a recess to receive the top of a sample vial and a septum for covering the opening of a sample vial and comprised of elastic material which is self-resealing after being pierced by a needle, said septum being generally circular with a plurality of radially extending protrusions configured for frictional resilient engagement with said side wall of said cap to retain said septum within said recess without deformation or distortion during positioning of the closure on a sample vial.

2. The device of claim 1 wherein said protrusions are equi-spaced about the circumference of said septum and extend radically outwardly.

3. The device of claim 1 wherein said protrusions are tapered.

4. The device of claim 1 which comprises an annular disk having a central aperture and being diametrically smaller than said recess of said cap, said disk being disposed within said recess between said top wall of said cap and said septum, said septum engaging said sidewall to retain said septum and said disk within said recess during positloning of said closure on a sample vial.

5. The device of claim 4 wherein said disk has a plurality of radially extending protrusions for centering said disk within said recess to align said disk aperture with said cap aperture.

6. The device of claim 1, wherein said septum is made of butyl rubber.

7. The device of claim 1 wherein said septum is made of silicone rubber, which is laminated with PTFE.

8. The device of claim 1 wherein said septum is made of silicone rubber, which is laminated with aluminum.

9. The device of claim 1 comprising an annular disc configured for mounting within said recess of said cap between said top wall of said cap and said septum, said disc having a central aperture smaller than said aperture of said cap, and said radially extending protrusions being configured for frictional resilient engagement with said side wall of said cap to retain said disc within said recess during positioning of the closure on a sample vial without deformation or distortion of said septum.

10. A method of assembling a closure of the type having a cap and septum on a sample vial for use in gas chromatogoraphy comprising the steps of:

positioning the septum within the cap, frictionally securing the septum within the cap without deformation or distortion of the septum prior to mounting the cap on the sample vial, and mounting the cap to the sample vial to seal the vial opening with the septum.

11. The method of claim 10 which comprises positioning an annular disc between the cap and septum and frictionally securing the septum within the cap prior to mounting the cap on the sample vial so as to retain the annular disc between the cap and septum during the mounting of the cap on the sample vial without deforming or distorting the septum.

* * * * *